United States Patent [19]

Baker

[11] 4,133,059

[45] Jan. 9, 1979

[54] AUTOMATED SURGE WEIR AND RIM SKIMMING GUTTER FLOW CONTROL SYSTEM

[76] Inventor: William H. Baker, 911 Rawlinson Rd., Rock Hill, S.C. 29730

[21] Appl. No.: 834,584

[22] Filed: Sep. 19, 1977

Related U.S. Application Data

[60] Division of Ser. No. 663,161, Mar. 2, 1976, abandoned, which is a continuation-in-part of Ser. No. 640,825, Dec. 15, 1975, abandoned.

[51] Int. Cl.[2] ..... E04H 3/16; E04H 3/20

[52] U.S. Cl. ..... 4/172.17

[58] Field of Search ..... 4/172, 172.18, 172.15, 4/172.16, 172.17; 210/169, 102, 104, 105, 123, 126; 137/386, 409; 61/22 R, 25, 28

[56] References Cited

U.S. PATENT DOCUMENTS

| | | | |
|---|---|---|---|
| 1,800,387 | 4/1931 | Everson | 210/169 X |
| 2,809,752 | 10/1957 | Leslie | 4/172.17 |
| 3,212,268 | 10/1965 | Ortega | 61/28 |
| 3,252,576 | 5/1966 | Miller | 61/28 |
| 3,363,767 | 1/1968 | Ellis | 4/172.17 |
| 3,386,107 | 6/1968 | Whitten | 4/172 |
| 3,537,111 | 11/1970 | Whitten | 4/172.17 |
| 3,668,713 | 6/1972 | Baker | 4/172.17 |
| 3,739,405 | 6/1975 | Schmidt | 4/172.15 |
| 3,815,160 | 6/1974 | Baker | 4/172 X |
| 3,848,627 | 11/1974 | Page | 4/172.17 |
| 3,895,402 | 7/1975 | Page | 4/172.17 |
| 3,908,207 | 9/1975 | Van den Broek | 4/172.17 |

FOREIGN PATENT DOCUMENTS

| | | | |
|---|---|---|---|
| 16917 | 3/1934 | Australia | 4/172.17 |

*Primary Examiner*—Stuart S. Levy

[57] ABSTRACT

A fully automated surge weir and rim skimming gutter flow control system is provided, automatically establishing and controlling surge weir and rim skimming gutter flow under both normal and extraordinary pool use conditions, sensing changes in water level and water activity, and actuating appropriate response mechanisms controlling surge weir and rim skimming gutter flow and/or rate of recirculation of the water between the pool and the filtration system with switches to convert the gutter from weir skimming and back.

7 Claims, 2 Drawing Figures

AUTOMATED SURGE WEIR AND RIM SKIMMING GUTTER FLOW CONTROL SYSTEM

This is a division of application Ser. No. 663,161 filed Mar. 2, 1976, now abandoned which in turn is a continuation in part of Ser. No. 640,825 filed Dec. 15, 1975; now abandoned.

Automatic control at all times of the water level in a pool requires prompt response to changes in operating conditions, and is not easy to achieve. Many attempts have been made, but a fully automated response to all use conditions has not in fact been obtained.

Establishment and maintenance of the water level in a pool when the pool is quiescent is relatively easy. One system for automatically maintaining pool level, sensing pool level by a float in a surge and level control tank, and feeding make-up water to the pool by a float-operated valve, is described in U.S. Pat. No. 3,386,107 to G. R. Whitten Jr., patented June 4, 1968. It is desirable of course to avoid placing a float directly in the pool, since not only would a float be in the way of swimmers, but the float would also be subject to changes in water level due to wave action. These problems are avoided by placing the float in a separate surge and level control tank, connected to the pool below the surface, so that the control responds only to static pool level. When the static level is below a predetermined level, make-up water is added even though the pool surface may be turbulent. In the system of this patent, the make-up water is added to the control chamber in the tank, in which the float sinks to detect a low water level, and excess water is also withdrawn by overflow or drain provided through the control tank. However, as noted by Whitten Jr. in a later U.S. Pat. No. 3,537,111 patented Nov. 3, 1970, the cost of such an elaborate surge and level control tank adds substantially to the total construction cost of the pool.

A further system noted by Whitten Jr. in U.S. Pat. No. 3,537,111 is to provide a sump separated from the pool by a ledge which sets a level for overflow, and a make-up water supply valve feeding directly into the sump under the control of a float. A drain valve is connected to the same float for draining the sump to a recirculating pump whenever the sump tends to overfill. However, this system does not correct flooding of the sump to the pool level by rain or overfilling, and no peripheral gutter is provided in this system, which also requires the construction of a separate sump tank which has to be placed at pool side, rather than located remotely at a location which would be both more convenient and less obstructive of the deck around the pool.

Accordingly, in U.S. Pat. No. 3,537,111, patented Nov. 3, 1970, Whitten Jr. proposed a modified system in which all water level sensors sense water level in the drainage gutter, and not in the pool. The level of drainage flow in the single peripheral gutter is detected at one level or a range of levels. The gutter has an overflow lip or weir for skimming flow at the desired pool height, and delivers overflow to a recirculating pump and filter, which may also draw water from drains under the pool surface. The detecting means controls a valve in a make-up water supply line which either feeds the pool directly, or feeds the recirculating pump, if prefiltration is desired. The control is arranged to open the make-up valve, if the drainage flow falls below a level that will guarantee maintenance of continuous overflow all around the periphery of the pool, taking the provision of a hydraulic gradient in the gutter into account. If the drainage flow rises beyond a normal operating level, which is sufficiently lower than the gutter lip to allow ample space in the gutter to receive abnormal flow caused by pool surge, the control closes the make-up valve and discontinues the supply to the pool.

Means is also provided for increasing the rate of drainage of the gutter under flooding conditions, detecting the level of the drainage flow to control the main drain valve. The control is arranged to partially close the main drain valve to reduce the proportion of the recirculating flow which is drawn from the main drain whenever the gutter flow substantially fills the gutter space reserved for surge and approaches the level of the overflow drain pipe. The effect of this is to increase the rate of flow taken by the recirculating pump from the gutter, and thus hasten a drop in the drainage overflow in the gutter to a suitable operating level. As this level returns to normal, the control reopens the main drain valve to restore the original proportioning of the recirculating flow taken from the gutter and the pool.

The system does however have an inadequate gutter capacity to respond to high gutter flooding conditions.

Higher than normal pool levels, substantially higher than the overflow lip of the gutter, must be prevented from entering the gutter, therefore, by covering the gutter with a grille having drain holes whose total area is calculated to admit only the maximum recirculation flow rate that can be handled by the gutter. Such water is retained on the grille, and accordingly washes back to the pool without entering the gutter, which is undesirable, since this washed dirt and debris collected on the grille back into the pool, and accordingly fails to meet modern health code requirements.

In order to prevent this, it is necessary to provide a gutter system of considerably increased capacity, such as a double gutter of the type provided, for example, in U.S. Pat. Nos. 3,668,712, 3,668,713, 3,668,714 and 3,815,160 to Baker. However, the control system of No. 3,537,111 is not suitable for use in a double gutter pool.

In accordance with the invention of Ser. No. 640,825, a fully automated water level and skimming flow perimeter gutter control system for swimming pools is provided, comprising a gutter receiving overflow, including surge flow and/or skimming flow, across the top of the perimeter gutter and adequate for normal and surge flow conditions, and optionally, a second gutter receiving skimming flow and also providing additional gutter capacity for extraordinary overflow, including relief flow from the first gutter in the event of considerable activity in the pool, in combination with a level-sensing pool and overflow control system operating from the level of water in the pool and from the level of water in the pool overflow, such as in the gutter conduit, or in a balance tank or a vacuum filter tank, to control the skimming flow and water recirculation between the pool and the gutter, and feed from a water-make-up supply.

In accordance with the invention of Ser. No. 663,161, filed Mar. 2, 1976, a fully automated surge weir and rim skimming flow perimeter gutter control system for swimming pools is provided, comprising a gutter receiving overflow, including surge flow and rim skimming flow, across the top of the perimeter gutter and adequate for normal and surge flow conditions, and optionally a second gutter receiving skimming flow and also providing additional gutter capacity for extraordinary overflow, including relief flow from the first gutter in the event of considerable activity in the pool, in combination with a level-sensing pool overflow control system operating from the level of water in the pool overflow, such as in the gutter conduit, or in a balance tank or a vacuum filter tank, to control at least one of the surge weir and rim skimming flow and/or water recirculation flow between the pool and the gutter, and optionally, in addition, water feed from a water make-up supply.

In accordance with the present invention, the system of Ser. No. 663,161 is modified to include switches to convert the gutter from weir skimming to rim skimming, and back.

The flow control system of this invention accommodates any increase in pool activity above the quiescent condition that results in a greater-than-normal skimming flow through the surge weirs and/or over the rim into the skimming gutter, and that in turn causes the pool water overflow level to rise, in the gutter and elsewhere downstream.

In the event the gutter system includes one or more surge weirs, arranged in weir passages, an overflow sensor is provided, such as in the gutter, responsive to a pool overflow water level corresponding to a low activity pool condition, above the normal surge weir skimming flow level (which can be sensed in the pool by a pool sensor). When the pool overflow level reaches the level of this overflow sensor, the sensor actuates a mechanism closing off the surge weirs, arresting skimming flow through the weirs, and retaining the water in the pool, but allowing skimming flow and/or flow surges to proceed across the top rim of the pool perimeter, into the gutter.

A further increase in pool activity to a higher level corresponding to moderate pool activity will increase the overflow water level such as in the gutter. If a two-gutter system is provided, the water level in the first gutter will eventually reach the flooding level, and thus an overflow connection is provided between the first and second gutters, so that such water instead of flooding the first gutter and returning to the pool flows from the first gutter to the second gutter.

In the event provision is made to increase or decrease water recirculation flow according to pool activity, a response is provided when pool activity is moderate.

Under moderate pool activity, there is more water overflow, and this overflow taxes the normal water recirculation system, which may receive flow not only from the gutter but also from the main drain in the pool. Consequently, the overflow water level, such as in the gutter, rises, until it encounters a sensor at a predetermined overflow water level, a sensor which controls the position of a recirculating flow throttling control valve on the return line of the recirculation system. This valve can at normal quiescent or light pool activity provide a normal recirculation flow, but upon demand, at moderate or heavy pool activity, the valve can be actuated by the second sensor to provide a higher recirculation flow. The throttling valve thus makes it possible to design the recirculation system to accommodate any excess flow above the normal recirculation rate, as may be required according to the amount of pool activity to be expected, or the amount of skimming flow through any weirs and/or across the top of the perimeter rim.

Alternatively, or in addition, this sensor can be put in operating connection with the main drain valve, and when this water level is reached, the water recirculation system capacity for gutter flow can be increased by closing off the main drain valve, causing all recirculation water between the pool and the pool recirculation system to flow into the system from the gutter.

If the throttling control valve were not opened, or if the recirculating flow main drain were not cut off, the recirculation system would be unable to accommodate the increased overflow, and the overflow would begin to back up in the gutter system. Consequently, this sensor prevents flooding of the gutters and back-wash to the pool under the increased overflow, as a result of this higher level of activity.

Upon a further increase in pool activity, to the maximum, i.e., operation of the pool at the rim flow level, providing skimming flow across the top of the gutter, the amount of overflow into the gutter increases still further. Eventually, such activity raises the overflow water level such as in the gutter to an overflow water level at which the capacity of the recirculation system is again exceeded, and must be increased further, to prevent gutter flooding and wash-back. At this point an overflow sensor is actuated which further increases recirculating flow, either by opening the recirculating flow throttling control valve on the return line of the recirculation system, to increase the amount of water drawn through the filter, and/or by opening the main drain valve (if not opened previously) and/or by opening a bypass line to bypass the filter, so as to permit the recirculation system to accommodate the excess overflow generated under such conditions.

An optional feature is control of normal pool water level. For this purpose (as in Ser. No. 640,825) two sensors are provided. An overflow sensor senses a level of water in the overflow, such as in the gutter or balance tank or vacuum filter tank, corresponding to a predetermined below-normal skimming flow, and when this level is reached, opens a make-up valve controlling feed of fresh water from a supply or the water main. A pool sensor senses the level of the water in the pool, and is arranged to close the make-up water valve whenever the pool water level reaches a predetermined normal quiescent level at which skimming flow via surge weirs or a skimming gutter proceeds, and overflows into the gutter. This equilibrium condition continues while skimming flow remains at a rate corresponding to a quiescent pool condition.

The several sensors can be double-acting, i.e., actuated at their predetermined water level, whether that level is reached by a declining flow or by a rising flow, or single-acting, in which case one set of sensors responds to rising level and a second set of sensors can be used if desired responding to declining flow, or a combination of both. Consequently, a declining flow can be made to reverse the sequence of actuation response noted above.

Accordingly, the control system in accordance with the invention makes it possible automatically to accommodate any amount of pool activity without gutter flooding or washing back of debris and contaminants in the gutters into the pool, permitting skimming flow through surge weirs and/or over the perimeter rim, as may be desired.

One embodiment of automated pool perimeter skimming gutter water level control system of the invention comprises, in combination, a gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit; at least one surge weir disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flow, wave actions and surges up to a predetermined minimum, while allowing excessive flows, wave actions and surges beyond such minimum to flow over the top of the wall into the gutter conduit; a water cleaning and recirculating system for collecting water from the pool and water flowing into and along the gutter conduit, cleaning it, and returning it to the pool; and an overflow sensor sensing a water level in the overflow downstream of the pool characteristic of a low threshold of pool activity, but excessive weir skimming flow, and arranged to close at least one weir.

Another embodiment of automated pool perimeter skimming gutter water level control system of the invention comprises, in combination, a gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit, the top rim of the wall being placed at a height to maintain a predetermined water level in the pool, to provide a skimming flow of water at such predetermined water level in the pool, and to allow excessive flows, wave actions and surges to flow over the top rim of the wall into the gutter conduit; a water cleaning and recirculating system for collecting water from the pool and water flowing into and along the gutter conduit, cleaning it, and returning it to the pool; and an overflow sensor sensing an overflow level characteristic of an above-normal skimming flow and corresponding to a level of pool activity above a normal quiescent pool condition, and arranged to increase water recirculation system capacity to accommodate such increased overflow, and prevent wash-back from a gutter conduit to the pool.

Another embodiment of automated pool perimeter skimming gutter water level control system of the invention comprises, in combination, a gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit; at least one surge weir disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flow, wave actions and surges up to a predetermined minimum, while allowing excessive flows, wave actions and surges to flow over the top rim of the wall into the gutter conduit; a water cleaning and recirculating system for collecting water from the pool and water flowing into and along the gutter conduit, cleaning it, and returning it to the pool; and an overflow sensor sensing an overflow level characteristic of an above-normal skimming flow and corresponding to a level of pool activity above a normal quiescent pool condition, and arranged to increase water recirculation system capacity to accommodate such increased overflow, and prevent wash-back from a gutter conduit to the pool.

To avoid the restriction of a limited flow through a filter, a bypass line can be incorporated to allow some or all such excess flow to bypass the filter.

A further embodiment of automated pool perimeter skimming gutter water level control system of the invention comprises, in combination, a gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit, the top rim of the wall being placed at a height to maintain a predetermined water level in the pool, to provide a skimming flow of water over the top rim at such predetermined water level in the pool, and to allow excessive flows, wave actions and surges to flow over the top rim of the wall into the gutter conduit; a water cleaning and recirculating system for collecting water from the pool and water flowing into and along the gutter conduit, cleaning it, and returning it to the pool; and including a water recirculation throttling valve controlling the capacity for recirculating water flow of the water cleaning and recirculating system; and an overflow sensor sensing a higher level in the overflow downstream of the pool characteristic of an above-normal water flow, wave action and surges into the gutter conduit, and arranged to adjust the water recirculation throttling valve to increase recirculation system capacity to accommodate such increased overflow, and prevent wash-back from a gutter conduit to the pool.

A preferred embodiment of twin-gutter automated pool perimeter skimming gutter water level control system of the invention comprises, in combination, a first gutter conduit for disposition about the perimeter of a swimming pool, and adapted to carry water at a level below a predetermined level of water in the swimming pool; a second gutter conduit for disposition above the perimeter of a swimming pool, and adapted to carry water at a level below a predetermined level of water in the swimming pool; a retaining wall on the pool side of the gutter conduit, over the top rim of which wall water may flow from the pool into a gutter conduit; the top rim of the wall being placed at a height to maintain a predetermined water level in the pool, to provide a skimming flow of water at such predetermined water level in the pool, and to allow excessive flows, wave actions and surges to flow over the top rim of the wall into a gutter conduit; a water cleaning and recirculating system for collecting water from the pool and water flowing into and along the first and second gutter conduits, cleaning it, and returning it to the pool; and an overflow sensor sensing a water level in the overflow downstream of the pool characteristic of a high degree of water flow, wave action and surges into the gutter conduit, and arranged to increase water recirculation system capacity to recirculate such increased overflow and prevent wash-back from a gutter conduit to the pool.

Another embodiment of twin-gutter automated pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the first gutter conduit, over the top rim of which wall water may flow from the pool into the first gutter conduit; a second gutter for disposition above the perimeter of a swimming pool, and adapted to carry water at a level below a predetermined level of water in the swimming pool; the top rim of the wall being placed at a height to maintain a predetermined water level in the pool, to provide a skimming flow of water over the top rim of the wall at such predetermined water level in the pool, and allow excessive flows, wave actions and surges to flow over the top rim of the wall into the first gutter conduit; a water cleaning and recirculating system for collecting water from the pool and water flowing into and along the first and second gutter conduits, cleaning it, and returning it to the pool; and including a water recirculation throttling valve controlling the capacity for recirculating water flow of the water cleaning and recirculating system; and an overflow sensor sensing a water level in the overflow downstream of the pool characteristic of a high degree of water flow, wave action and surges into the first gutter conduit, and arranged to adjust the water circulation throttling valve to increase recirculation system capacity to accommodate such increased overflow, and prevent wash-back from a gutter to the pool.

Another embodiment of automated pool perimeter skimming gutter water level control ststem of the invention comprises, in combination, a first gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit; a second gutter conduit for disposition about the perimeter of a swimming pool, and adapted to carry water at a level below a predetermined level of water in the swimming pool; at least one surge weir disposed through the retaining wall below the top thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top rim of the wall into the first gutter conduit; a water cleaning and recirculating system for collecting water from the pool and water flowing into and along the first and second gutter conduits, cleaning it, and returning it to the pool; and an overflow sensor sensing a water level in the overflow downstream of the pool characteristic of a low threshold of pool activity but excessive weir skimming flow, and arranged to close at least one weir.

Another embodiment of twin-gutter automated pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the first gutter conduit, over the top rim of which wall water may flow from the pool into the first gutter conduit; a second gutter conduit for disposition about the perimeter of a swimming pool, and adapted to carry water at a level below a predetermined level of water in the swimming pool; at least one surge weir disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top rim of the wall into the first gutter conduit; a water cleaning and recirculating system for collecting water from the pool and water flowing into and along the first and second gutter conduits, cleaning it, and returning it to the pool; a first gutter sensor sensing a first water level in a gutter characteristic of a low threshold of pool activity but excessive weir skimming flow, and arranged to close at least one weir; and a second sensor sensing a second higher level in the second gutter characteristic of a high degree of water flow, wave action and surges into the first gutter conduit, and arranged to increase water recirculation system capacity to recirculate such increased gutter flow and prevent wash-back from a gutter conduit to the pool.

Another embodiment of automated pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit; a second gutter conduit for disposition about the perimeter of a swimming pool, and adapted to carry water at a level below a predetermined level of water in the swimming pool; at least one surge weir disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flows, wave actions and surges up to a predetermined minimum, while allowing excessive flows, wave actions and surges beyond such mimimum to flow over the top rim of the wall into the first gutter conduit; a water cleaning and recirculating system for collecting water from the pool and water flowing into and along the first and second gutter conduits, cleaning it, and returning it to the pool; and including a water recirculation throttling valve controlling the capacity for recirculating water flow of the water cleaning and recirculating system; a first sensor sensing a first water level in the second gutter characteristic of a low threshold of pool activity but excessive weir skimming flow, and arranged to close at least one weir; and a second sensor sensing a second higher level in the second gutter characteristic of a high degree of water flow, wave action and surges into the first gutter conduit, and arranged to adjust the water recirculation throttling valve to increase water recirculation system capacity to recirculate such increased gutter flow and prevent wash-back from a gutter conduit to the pool.

Another embodiment of automated pool perimeter skimming gutter water level control system of the invention comprises, in combination, a gutter conduit for disposition about the perimeter of a swimming pool, and adapted to carry water at a level below a predetermined level of water in the swimming pool; a retaining wall on the pool side of the gutter conduit, over the top of which wall water may flow from the pool into the gutter conduit; at least one surge weir disposed through the retaining wall below the top thereof, at a height to maintain a predetermined water level in the pool, and to provide a skimming flow of water through the weir at such predetermined water level in the pool, the top of the wall being spaced above the weir at a height to retain the pool water within the pool perimeter when the weir is closed as water flows, wave actions and surges up to a predetermined minimum, while allowing excessive flows, wave actions and surges beyond such minimum to flow over the top of the wall into the gutter conduit; a water cleaning and recirculating system for collecting water from the pool and water flowing into and along the gutter conduit, cleaning it, and returning it to the pool; and including a water recirculation throttling valve controlling the capacity for recirculating water flow of the water cleaning and recirculating system; a first overflow sensor sensing a first water level in the overflow downstream of the pool characteristic of a low threshold of pool activity but excessive weir skimming flow, and arranged to close at least one weir; a second overflow sensor sensing a second higher level in the overflow downstream of the pool characteristic of a high degree of water flow, wave action and surges into the gutter conduit, and arranged to increase water recirculation system capacity to recirculate such increased gutter flow; and a third overflow sensor sensing a third higher level in the overflow downstream of the pool characteristic of a higher degree of water flow, wave action and surges into the gutter conduit; and arranged to adjust the water recirculation throttling valve to increase recirculation system capacity to accommodate such increased overflow, and prevent wash-back from the gutter conduit to the pool.

Another embodiment of twin-gutter automated pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the first gutter conduit, over the top of which wall water may flow from the pool into the first gutter conduit; a second gutter conduit for disposition about the perimeter of a swimming pool, and adapted to carry water at a level below a predetermined level of water in the swimming pool; at least one surge weir disposed through the retaining wall below the top thereof, at a height to maintain a predetermined water level in the pool, and to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the first gutter conduit; a water cleaning and recirculating system for collecting water from the pool and water flowing into and along the first and second gutter conduits, cleaning it, and returning it to the pool; and including a water recirculation throttling valve controlling the capacity for recirculating water flow of the water cleaning and recirculating system; a first gutter sensor sensing a higher water level in a gutter characteristic of a low threshold of pool activity but excessive weir skimming flow, and arranged to close at least one weir; a second sensor sensing a higher level in a gutter characteristic of a high degree of water flow, wave action and surges into the first gutter conduit, and arranged to increase water recirculation system capacity to recirculate such increased gutter flow to the pool; and a third sensor sensing a higher level in a gutter characteristic of a higher degree of water flow, wave action and surges into the conduit, and arranged to adjust the water recirculation throttling valve to increase recirculation system capacity to accommodate such increased gutter flow, and prevent wash-back from a gutter conduit to the pool.

A further feature of the control system in accordance with the invention is the provision of an overriding control such as an electric switch, to make it possible to operate skimming flow either through weirs or over the perimeter rim, as desired, while retaining any and all other automatic controls, to accommodate any amount of pool activity without gutter flooding or washing back of debris and contaminants in the gutters into the pool, permitting skimming flow through surge weirs and/or over the perimeter rim, as may be desired.

One embodiment of such a pool perimeter skimming gutter water level control system of the invention comprises, in combination, a gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit; at least one surge weir disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flow, wave actions and surges up to a predetermined minimum, while allowing excessive flows, wave actions and surges beyond such minimum to flow over the top of the wall into the gutter conduit; a water cleaning and recirculating system for collecting water from the pool and water flowing into and along the gutter conduit, cleaning it, and returning it to the pool; an overflow sensor sensing a water level in the overflow downstream of the pool characteristic of a low threshhold of pool activity, but excessive weir skimming flow, and arranged to close at least one weir; and means over-riding the overflow sensor to close the weir and direct all skimming flow over the top rim of the retaining wall.

Another embodiment of such a pool perimeter skimming gutter water level control system of the invention, utilizing a twin-gutter pool perimeter skimming gutter, comprises, in combination, a first gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit; a second gutter conduit for disposition about the perimeter of a swimming pool, and adapted to carry water at a level below a predetermined level of water in the swimming pool; at least one surge weir disposed through the retaining wall below the top thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top rim of the wall into the first gutter conduit; a water cleaning and recirculating system for collecting water from the pool and water flowing into and along the first and second gutter conduits, cleaning it, and returning it to the pool; an overflow sensor sensing a water level in the overflow downstream of the pool characteristic of a low threshold of poor activity but excessive weir skimming flow, and arranged to close at least one weir; and means overriding the overflow sensor to close the weir and direct all skimming flow over the top rim of the retaining wall.

Another embodiment of such a twin-gutter pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the first gutter coduit, over the top rim of which wall water may flow from the pool into the first gutter conduit; a second gutter conduit for disposition about the perimeter of a swimming pool, and adapted to carry water at a level below a predetermined level of water in the swimming pool; at least one surge weir disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top rim of the wall into the first gutter conduit; a water cleaning and recirculating system for collecting water from the pool and water flowing into and along the first and second gutter conduits, cleaning it, and returning it to the pool; a first gutter sensor sensing a first water level in a gutter characteristic of a low threshold of pool activity but excessive weir skimming flow, and arranged to close at least one weir; means overriding the overflow sensor to close the weir and direct all skimming flow over the top rim of the retaining wall; and a second sensor sensing a second higher level in the second gutter characteristic of a high degree of water flow, wave action and surges into the first gutter conduit, and arranged to increase water recirculation system capacity to recirculate such increased gutter flow and prevent wash-back from a gutter conduit to the pool.

Another embodiment of such a twin-gutter pool perimeter skimming gutter water level control system of the invention comprises, in combination, a first gutter conduit for disposition about the perimeter of a swimming pool, and adapted to carry water at a level below a predetermined level of water in the swimming pool a retaining wall on the pool side of the gutter conduit, over the top rim of which wall water may flow from the pool into the gutter conduit; a second gutter conduit for disposition about the perimeter of a swimming pool, and adapted to carry water at a level below a predetermined level of water in the swimming pool; at least one surge weir disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top rim of the wall into the first gutter conduit; a water cleaning and recirculating system for collecting water from the pool and water flowing into and along the first and second gutter conduits, cleaning it, and returning it to the pool; and including a water recirculation throttling valve controlling the capacity for recirculating water flow of the water cleaning and recirculating system; a first sensor sensing a first water level in the second gutter characteristic of a low threshhold of pool activity but excessive weir skimming flow, and arranged to close at least one weir, means overriding the overflow sensor to close the weir and direct all skimming flow over the top rim of the retaining wall; and a second sensor sensing a second higher level in the second gutter characteristic of a high degree of water flow, wave action and surges into the first gutter conduit, and arranged to adjust the water recirculation throttling valve to increase water recirculation system capacity to recirculate such increased gutter flow and prevent wash-back from a gutter conduit to the pool.

Another embodiment of such a pool perimeter skimming gutter water level control system of the invention comprises, in combination, a gutter conduit for disposition about the perimeter of swimming pool, and adapted to carry water at a level below a predetermined level of water in the swimming pool; a retaining wall on the pool side of the gutter conduit, over the top of which wall water may flow from the pool into the gutter conduit; at least one surge weir disposed through the retaining wall below the top thereof, at a height to maintain a predetermined water level in the pool, and to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the gutter conduit; a water cleaning and recirculating system for collecting water from the pool and water flowing into and along the gutter conduit, cleaning it, and returning it to the pool; and including a water recirculation throttling valve controlling the capacity for recirculating water flow of the water cleaning and recirculating system; a first overflow sensor a first water level in the overflow downstream of the pool characteristic of a low threshold of pool activity but excessive weir skimming flow, and arranged to close at least one weir; means overriding the overflow sensor to close the weir and direct all skimming flow over the top rim of the retaining wall; a second overflow sensor sensing a second higher level in the overflow downstream of the pool characteristic of a high degree of water flow, wave action and surges into the gutter conduit, and arranged to increase water recirculation system capacity to recirculate such increased gutter flow; and a third overflow sensor sensing a third higher level in the overflow downstream of the pool characteristic of a higher degree of water flow, wave action and surges into the gutter conduit; and arranged to adjust the water recirculation throttling valve to increase recirculation system capacity to accommodate such increased overflow, and prevent wash-back from the gutter conduit to the pool.

Another embodiment of twin-gutter automated pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the first gutter conduit, over the top of which wall water may flow from the pool into the first gutter conduit; a second gutter conduit for disposition about the perimeter of a swimming pool, and adapted to carry water at a level below a predetermined level of water in the swimming pool; at least one surge weir disposed through the retaining wall below the top thereof, at a height to maintain a predetermined water level in the pool, and to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the first gutter conduit; a water cleaning and recirculating system for collecting water from the pool and water flowing into and along the first and second gutter conduits, cleaning it, and returning it to the pool; and including a water recirculation throttling valve controlling the capacity for recirculating water flow of the water cleaning and recirculating system; a first gutter sensor sensing a higher water level in a gutter characteristic of a low threshhold of pool activity but excessive weir skimming flow, and arranged to close at least one weir; means overriding the overflow sensor to close the weir and direct all skimming flow over the top rim of the retaining wall; a second sensor sensing a higher level in a gutter characteristic of a high degree of water flow, wave action and surges into the first gutter conduit, and arranged to increase water recirculation system capacity to recirculate such increased gutter flow to the pool; and a third sensor sensing a higher level in a gutter characteristic of a higher degree of water flow, wave action and surges into the conduit, and arranged to adjust the water recirculation throttling valve to increase recirculation system capacity to accommodate such increased gutter flow, and prevent wash-back from a gutter conduit to the pool.

The weir or weirs for skimming flow can be skimming slots, as in U.S. Pat. Nos. 3,668,712 and 3,668,714, the slots feeding water directly into the second gutter conduit.

The overflow level can be sensed by overflow sensors at any position downstream of the pool where a water level correlated with pool activity and skimming flow exists, and can be detected. One such location is in the gutter. If there be more than one gutter, the second gutter downstream of the first gutter is preferred, but any gutter can be used. Another location is in a balance tank or vacuum filter tank before the pump receiving gutter flow in the water recirculation system.

The water level sensing and control system of the invention is applicable to any design of single or multiple gutter perimeter gutter system.

U.S. Pat. No. 3,668,712 to William H. Baker dated June 13, 1972, provides a perimeter skimming gutter for swimming pools including a gutter conduit for disposition about the perimeter of a swimming pool and adapted to carry water at a level below a predetermined level of water in the swimming pool, a retaining wall on the pool-side of the conduit, over the top of which wall water may flow from the pool into the gutter conduit, and a plurality of narrow elongated substantially horizontally disposed openings through the wall at a height to maintain a predetermined water flow, the top of the wall being spaced above the openings at a height to retain the pool water within the pool perimeter at water flows, wave actions and surges up to a predetermined maximum, while allowing excessive water flows, wave actions and surges beyond such maximum to flow over the top of the wall into the gutter conduit.

U.S. Pat. No. 3,668,714 to William H. Baker dated June 13, 1972, provides a nonflooding perimeter skimming gutter for swimming pools including a first gutter conduit for disposition about the perimeter of a swimming pool, and adapted to carry water at a level below a predetermined level of water in the swimming pool, a retaining wall on the pool-side of the first gutter conduit over the top of which wall a skimming flow of water may run from the pool into the first gutter conduit, a second gutter conduit adapted to carry water at a level below a predetermined level of water in the first gutter conduit, and a fluid flow connection between the two gutter conduits at such level and below the top of the retaining wall allowing water flow from the first gutter conduit into the second gutter conduit whenever the water level on the first gutter conduit reaches the fluid flow connection, thereby inhibiting filling of the first gutter conduit appreciably above such level.

Both skimming gutter designs are quite satisfactory for most sizes of swimming pool. If their unusually large gutter capacity can at times be exceeded, then the gutter of U.S. Pat. No. 3,815,160 to William H. Baker, dated June 11, 1974, can be used.

This nonflooding perimeter skimming gutter wall permits an adequate skimming action at all times, and also provides for virtually unlimited surge capacity when the pool is in use, without the possibility of the gutter's flooding, or dirt in the gutter's being washed back into the pool. This is accomplished by combining a second gutter conduit within a peripheral wall of the swimming pool, making available for gutter flow the internal volume of the wall, in fluid connection with the first gutter conduit, and adapted to receive water from the first gutter conduit whenever the level of water in that gutter exceeds a predetermined maximum, established at the level of the fluid flow connection therebetween. This fluid flow connection is below the top of the retaining wall, so that the water level in the first gutter conduit cannot reach the top of the retaining wall. The second gutter conduit within the wall is entirely separate from the first, and is designed to provide an ample reserve flow capacity to accommodate any heavy or surge action that may be likely to be encountered. The fluid flow connection between the gutter conduits can be arranged to skim the dirt off the top of the first gutter trough, thus assisting in preventing this dirt from being washed back into the pool.

In this gutter system, the water level in the pool is normally maintained at the level at the top of the retaining wall, which consequently serves as a skimmer gutter at the pool perimeter. The fluid flow connection may constitute a second skimming flow outlet, supplementing and continuing the skimming action of the first.

The term "conduit" as used herein is inclusive of open conduits or troughs as well as partially or wholly enclosed conduits.

In a preferred embodiment of the invention the first gutter conduit is an open trough, with at least one fluid flow connection with the second gutter conduit in the form of one of a plurality of openings at the predetermined maximum level of water in the first gutter conduit.

The second gutter conduit preferably is a closed conduit. The second gutter conduit can be within any peripheral wall of the pool. It can, for example, be within the peripheral pool-side retaining wall. It can also be within a peripheral external wall of the gutter, on the side away from the pool.

In a preferred embodiment of the invention, a water-feed conduit is provided in the gutter for feed of fresh water into the pool. This conduit is preferably an integral part of the nonflooding perimeter skimming gutter, at the pool-side retaining wall, admitting water to the pool through the pool-side retaining wall.

In the case where the two gutters are separated by a common wall, the fluid flow connection between the two gutters can be of any configuration, and is in sufficient number and at a high enough level to provide for an adequate flow capacity, to prevent the water level in the first gutter conduit from appreciably exceeding the height of the overflow connection under any water surge or wave conditions in the pool.

The level of the overflow connections with respect to the bottom of the first gutter conduit can be adjustable, so as to provide adjustment of the water level permitted in the first gutter conduit before flow via the overflow connections into the second gutter conduit commences. This adjustment can be provided for by forming the overflow connections as vertical slots or with an extended vertical height, and disposing a movable barrier member over the overflow connections with the opening or openings of the desired size and shape.

A preferred embodiment of the invention is shown in the drawings in which:

FIG. 1 is a pool water flow circuit diagram, showing a twin-gutter pool perimeter water recirculation system with six sensors in a gutter level tank in connection with the second gutter.

This pool is adapted to operate automatically either in a surge weir operation or in a rim flow operation, as required. This is achieved by two sets of sensors, one for surge flow operation, and one for rim flow operation, of which one set is on-stream and the other off-stream, according to the mode selected.

Figure 1:
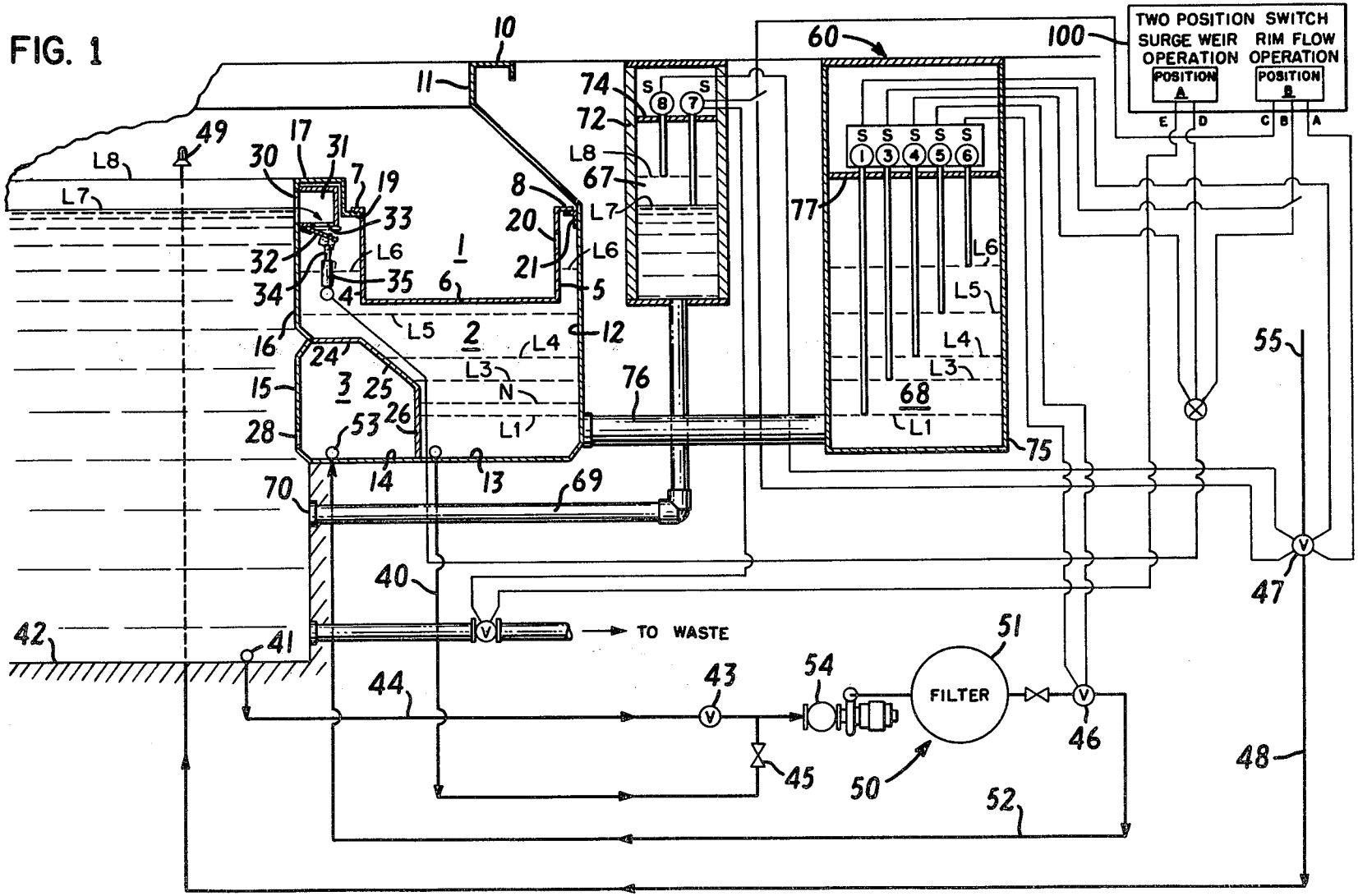
FIG. 1 is a pool water flow circuit diagram, showing a twin-gutter pool perimeter water recirculation system with a six-sensor automated control system of the invention imposed thereon, and with switches to convert the gutter from weir skimming to rim skimming and back.
Figure 2:
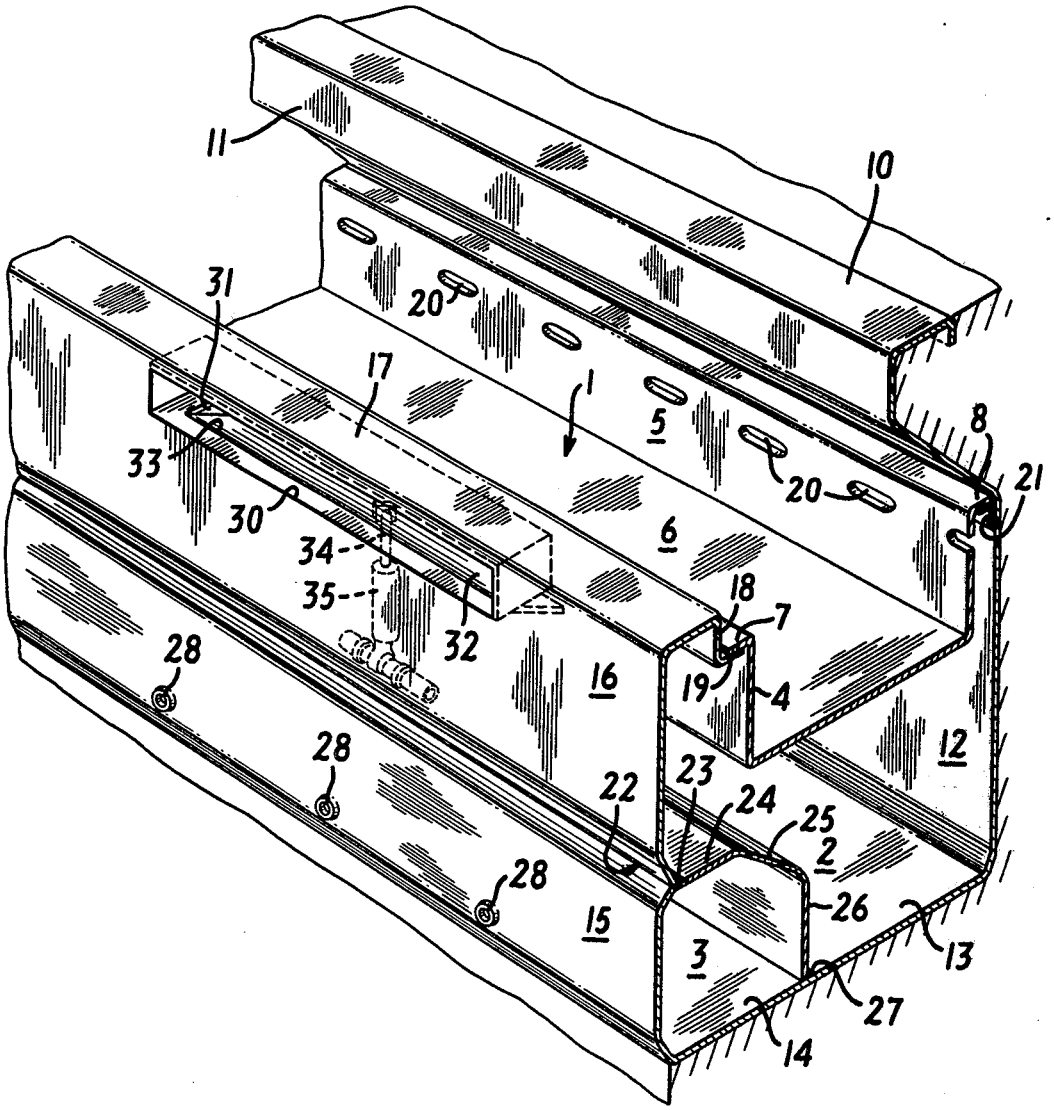
FIG. 2 is a view of one unit of the modular gutter of FIG. 1.

The pool perimeter gutter shown in FIGS. 1 and 2 is made in a plurality of modular units (best seen in FIG. 2), which are fitted together on-site and bonded together by welding, soldering or brazing in the number required to form the perimeter rim of a swimming pool. A sheet of stainless steel or other corrosion-resistant metal or plastic material is formed in the configuration shown, with a top coping 10, a gutter back wall 11, bent forward towards the pool in a manner to partially cover over a first gutter 1, and then continuing to form the back wall 12 and bottom wall 13 of a second gutter 2, the bottom wall 14 and pool perimeter side wall 15 of a water feed conduit 3, the pool perimeter side wall 16 of the second gutter 2, and the top wall 17 of the second gutter 2, which also serves as the top rim of the swimming pool, over which water may flow into the first gutter 1. The stainless steel sheet terminates in a flange 19, which serves as a ledge support for one side of the first gutter 1. A second flange 21 is attached by welding or brazing to the back wall 12 of the second gutter 2, to serve as the other ledge support for the first gutter 1.

The first gutter 1 is made of another sheet of stainless steel, formed in a U-configuration, with sides 4, 5, and bottom 6 terminating in flanges 7, 8, removably supporting the gutter on flanges 19, 21 of the first sheet. A grille can also be included, resting on flanges 7, 8 to cover over the open top of the first gutter, so as to prevent bathers from stepping into it, if desired, but is not necessary.

In the side wall 5 of the first gutter, there are several openings 20 in the form of short narrow slots providing fluid flow communication with the second gutter 2 near the top of the gutter 1. These openings define the maximum water level in the first gutter, since water above this level automatically flows through the openings 20 into the second gutter. The openings are sufficiently numerous and large to accommodate such flow, thus preventing flooding of the first gutter.

Through the pool perimeter side wall 16 of the second gutter are a number of narrow, long openings 30, approximately one-half inch below the top of the top of the gutter. These openings lead to weir passages 31, which accommodate skimming flow from the pool, and feed directly into the second gutter 2. Thus, skimming flow is separated from surge flow across the top 17 of the perimeter gutter, which feeds directly into the first gutter 1. Flaps 32 are provided across the openings 33 at the inner ends of the passages. These flaps on their undersides are pivotally mounted on the pistons 34, which are operated hydraulically in cylinders 35. The flaps can be lowered to the open position, shown in FIG. 1, by drawing in the piston, on the suction stroke, or pivoted to the dashed-line position shown in FIG. 1 to close off the weir passage 31, by pushing out the piston, on the power stroke. The opening and closing of the flaps can be effected by any kind of mechanism, however.

The pool perimeter walls 16 of the second gutter 2 and 15 of the water feed conduit 3 meet in a V-notch 22. At the base 23 of the V a third sheet of stainless steel is welded, and formed so as to extend inwardly and down to define the other sidewalls 24, 25, 26 of the water feed conduit 3, and is welded to the bottom 13 of the second gutter conduit 2 at 27.

A plurality of openings 28 are provided in the pool perimeter wall 15 of the water feed conduit 3, for feed of recirculating clean water to the pool. These openings can, if desired, be provided with nozzles or jets, in known manner, directing flow horizontally or downwardly into the pool.

There is a direct line connection 40 leading from the second gutter 2 and the first gutter 1 to the recirculation system 50, and there is also a main drain 41 in the bottom 42 of the swimming pool leading via main drain line 44 to the recirculation system. There is a main drain throttling valve 43 in the main drain line 44, so that this line can be closed off, or partially or fully opened, and there is also a gutter overflow valve 45 in the gutter line 40, so that this can be closed off. On the downstream side of the filter 51 in the water purifying system there is a recirculation flow throttling valve 46, which controls recirculation flow through the return feed line 52 leading to the water feed inlet 53 in the conduit 3. The valve 46 also can be partially or fully opened, or closed, increasing the recirculating flow or decreasing it, as may be required. The pump 54 maintains circulation of water through the filter 51 and return feed line 52 to the conduit 3.

There is also a make-up water valve 47 in fluid flow connection via a line 48 to the fillspout 49 on the deck of the pool, permitting introduction of fresh water from the water supply, such as, for example, the water main supply at the pool location.

The water level sensing system 60, best seen in FIG. 1, is composed of five gutter sensors S1, S3, S4, S5 and S6 of which S1, S3 and S4 are single acting, and S5, S6 double-acting, detecting five different water levels in the second gutter 2, and two single-acting pool level sensors S7, S8, detecting two different water levels in the pool. These water levels are sensed not in the second gutter or pool, but in pool level chamber 67 directly connected with the pool, and gutter level chamber 68 directly connected to the second gutter 2. The electric sensors S1, S3, S4, S5, S6, S7 and S8 and the actuating electric control circuit are well known, conventional and commercially available.

Pool level sensed in chamber 67 of the level tank 72 is communicated via the line 69, which is connected with the pool at 70, below the surface of the pool. The pool level tank 72 is so arranged as to reflect a range of pool levels ranging from a level at or below the bottom of the surge weir openings 30 to a level above the top 17 of the pool perimeter gutter.

The two electric sensors S7, S8 in the pool level chamber 67 can be adjusted in position on bracket mounting bar 74 so as to sense any desired pool level as water level in the chamber 67. Sensor S7 is normally in a position to sense when the pool is at a predetermined normal surge weir operating level L7 above the lower rim of openings 30, and is in electric connection with the make-up water valve 47, so as to turn off the make-up water valve 47 when the water level reaches or is below this sensor. Sensor S8 is in a position to detect level L8, when the pool water level is at normal skimming rim flow operating level. Accordingly, the pool sensor S8 cuts off feed of fresh water to the pool via valve 47 when the normal pool rim flow operating level L8 has been reached, with the surge weirs closed. Sensor S7 thus is the pool level control in the skimming weir flow operating mode, and Sensor S8 is the pool level control in the skimming rim flow operating mode.

A gutter level tank 75 is also provided, in fluid flow connection by the line 76 with the second gutter 2, at the bottom. In the chamber 68 of this level tank there are arranged the five gutter sensors S1, S3, S4, S5 and S6, each responding to a different level of water in the second gutter. The position of these sensors can also be adjusted up or down on bracket mounting bar 77, so that any desired combination of second gutter water levels can be detected, and an appropriate response effected.

The gutter sensor S1 senses and responds to a first level L1 of water in the second gutter 2, corresponding to the minimum pool level, at which the pool water level is below the predetermined skimming flow level above the lower rim of openings 30, and must be replenished. This sensor upon detecting such a low level responds by opening the make-up water valve 47, so that water is admitted from the feed line 55 into the line 48, and thence to the pool at fillspout 49.

The gutter sensor S4 senses a higher gutter water level L4 corresponding to the increased surge weir flow under light pool activity. When the water level reaches L4 it is because there is too much flow through the weirs, and it is necessary to close the surge weirs, to prevent excessive gutter flow. Sensor S4 responds to this condition by actuating the cylinder and pushing out the piston, closing the flaps 32, and closing off the weirs. In this condition, some surge flow cascades over the top 17 of the perimeter gutter into gutter 1, but gutter 1 has adequate capacity to accommodate such flow.

A further increase in pool activity will lead to an increased flow of water across the top 17 of the perimeter gutter into the first gutter 1. Under medium pool activity, the flow fills the gutter 1, whereupon the excess spills over into the second gutter 2, through the passages 20. This increases the water level in the second gutter, and increases the burden on the water recirculation system, which requires adjustment to accommodate the increased gutter flow.

Increased pool activity to the maximum activity level further increases the amount of water cascading across the top 17 of the perimeter gutter into gutter 1, and thence through the overflow openings 20 into gutter 2, with the result that the level in gutter 2 rises to level L6, sensed by the sensor S6. This sensor opens the recirculation flow throttling valve 46, increasing the rate (and therefore the volume amount) of recirculation flow through the recirculation system 50, so as to accommodate the increased flow through the gutters. This is so designed as to accommodate any maximum flow that may be encountered during maximum activity in the pool.

It is thus apparent that the sensor system in accordance with the invention not only senses and responds to the water level in the pool, but also to water level in the second gutter, so as to respond to activity in the pool at any desired level, as reflected in higher gutter flow, and adjust the water recirculation system to accommodate it without gutter flooding or spill back into the pool.

The necessary gutter capacity to accommodate the increased gutter flow during periods of pool activity, whether low or intense, is provided by the second gutter, thus ensuring that at no time does water washed into the gutter return to the pool without having first passed through the pool cleansing and recirculation system via the filter. The response to three different levels of activity, low, moderate, and high, is fully automatic in all cases.

As pool activity decreases, and gradually returns to normal, sensors are actuated so that the water recirculation system responds to the now decreased circulation through the gutters.

Thus, a decrease in the gutter level below level L6, to level L5, sensed by sensor S5, results in a throttling back of recirculation flow throttling valve 46. The gutter sensor S3 senses a water level L3 in the second gutter corresponding to a level of water above the normal operating level N, indicating the pool is quiescent so that the surge weir passages 31 can be opened and normal skimming flow provided through the surge weir passages via openings 33 into the second gutter. The sensor S3 responds to this level in the second gutter by opening the surge weirs, sending an electric signal to the piston 34 and cylinder 35 in the second gutter, and actuating the cylinder to withdraw the piston, so that the surge weir flaps 32 are opened to the position shown in FIG. 1, and this condition is maintained as long as the pool is quiescent, at normal pool operating level, i.e., at gutter level N. If for some reason, as for example, through heavy use, the amount of water decreases, so that level L1 is reached, the gutter sensor S1 opens the make-up valve 47, to restore the pool level to normal, and when the pool level is normal, the pool sensor S7 shuts off the valve 47, thus ensuring adequate skimming flow during periods of quiescence.

The water flow control system is consequently fully automatic, whether the flow to be accommodated is increasing or decreasing, and according to whether the activity in the pool is nil (quiescent), light, medium or heavy.

It will of course be appreciated that different degrees of activity intermediate these can be accommodated, by provision of additional sensors, and additional positions of either the recirculation flow throttling valve, or the gutter overflow and main drain systems.

The above description summarizes automatic surge flow operation. The system can also be operated in the rim flow mode, merely by flipping a switch.

The switch 100 controls the operating mode. In position A, the system operates in the surge flow mode. In position B, the system operates in the rim flow mode.

FIG. 1 shows both the sensor 3 circuit and the sensor 7 circuit in the open position, deactuating the sensors, as would be the case when the switch 100 is in position B. The sensor control circuits are deactuated since circuit B and circuit C when the switch is in position B energize to open the circuit to the sensors.

It will be noted that in position A, circuits D and E are energized, and that in position B, circuits A, B and C are energized. Circuit E controls the drain valve for waste disposal, and circuit D controls the surge weirs, opening them. Circuit C controls sensor S7, cutting it out of the system. Circuit B controls sensor S3, cutting it out of the system. Circuit A controls the make-up valve 47, opening it.

Thus, when switch 100 is thrown to position B, the make-up valve is opened, and the circuit from sensor S3 to the surge weir is cut off, so that the surge weirs cannot reopen, and sensor S7 is deactuated so water level can rise to level L8, controlled by sensor S8. As the water level rises to L4, sensor S4 closes the surge weirs, and since sensor S3 is cut out of the system, the surge weirs cannot reopen.

On the other hand, when switch 100 is thrown to position A, the circuit between sensor S3 and the surge weir is restored, so that then the surge weirs can be opened, the circuit to sensor S3 is reactuated, the drain to waste valve is opened, and the pool level is drawn down until it reaches level L7, normal surge weir operating level at which the drain valve is closed. After the water level in the pool drops below the rim, the water level in the gutter drops, and as the lvel passes through L3, sensor S3 is actuated and the surge weirs are then reopened, and the normal operating level is restored in the gutter corresponding to he normal pool operating level.

During the rim flow operating mode, skimming flow proceeds over the rim 17 into the first gutter 1, instead of the second gutter 2, so that the entire capacity of the second gutter 2 is available for surge flow when the pool is in use.

During the surge weir flow operating mode, the skimming flow proceeds through the weirs directly into the second gutter 2, so that the entire capacity of the first gutter 1 is available for surge flow when the pool is in use, plus the unused capacity of the second gutter 2.

The perimeter gutters and weirs shown in FIGS. 1 and 2 are made of stainless steel, but it will, of course, be understood that other metals can be used, such as galvanized iron and steel, and aluminum, as well as anodized aluminum. Whatever the metallic material, its surface should be treated so as to render it corrosion-resistant, as by plating, galvanizing, anodizing, porcelain-enamel coating, or painting. It is also possible to form the perimeter gutter and/or the weir of plastic material, either in whole or in part. There are plastics now available which are sufficiently strong to withstand the wear and tear of a perimeter gutter system, including, for example, acrylonitrile-butadiene-styrene resin, polycarbonate resin, polytetrfluoroethylene, polyvinyl chloride, polyvinylidene chloride, polyesters, polypropylene, polyamides, and synthetic rubbers such as polyisoprene, polybutadiene, butadiene-styrene copolymers, and butadiene-isoprene copolymers.

The preferred construction is from a sheet or several sheets of metallic or plastic material, which are formed into the desired configuration, as is seen in the cross-sectional drawings. It is usually preferred that the coping portion at the top rear of the perimeter gutter extend at least partially, and preferably wholly, across an open gutter trough, so as to prevent people from stepping or falling into the gutter. Such can also be prevented by covering the gutter with a grating or grid of metal or plastic, the same or different material from the gutter.

The use of modular units such as are shown in FIGS. 1 and 2 is preferred, because this permits mass production of the gutter and weir system at a point remote from the swimming pool, with easy and inexpensive transportation from that point to swimmining pool construction sites anywhere in the world. The modular units can then be assembled on-site to form any type or configuration of swimming pool, and any desired weir arrangement, The modular units can be made in straight sections for rectangular or other straight-sided pool shapes, while curved sections can be made for pear-shaped, elliptical, circular, or other curved-side pool configurations.

The modular units can be fitted together by welding, soldering or brazing, in the case of metal units; by bonding, using various types of adhesives, in the case of metal or plastic units; or by heat-sealing, ultrasonic welding, or heat-bonding, in the case of thermoplastic plastic units. Plastic units which are not fully heat-cured can be bonded and then cured in situ to form a permanent bond on site, in the course of construction of the pool.

The perimeter gutter and weir system of the invention can be used completely around the perimeter of a pool, or only partially around the pool perimeter, as desired. The most uniform skimming action and gutter action is, of course, obtained when the entire perimeter of the pool is provided with such a gutter and weir.

While construction of the gutter and weir in the form of modular units has been described, it will also be appreciated from FIGS. 1 and 2 that the gutter and weir system can be formed on-site in the configurations shown using concrete or plastic material, and can form an integral part of the pool wall, by casting or pouring into suitable frames, so that the material can harden and set in the desired pool and skimmer outlet shape. The construction of the gutter system is sufficiently simple so that this type of technique can be employed with good results. Since this requires more hand-work, however, and is therefore a more costly method of construction, it would not usually be preferred, particularly in the case of large pools, where construction cost may be too high to permit the luxury of a handmade gutter system on the pool site.

The gutter and weir system can also be made from bricks or tiles, which are built up in the desired configuration. These can be the usual types of materials, preferably with a ceramic facing, so that it is leak-proof, with the tiles being bonded together with water-resistance adhesive or cement.

The swimming pool can be equipped with any type of water filtration and cleaning recirculating system. The gutters usually feed water therein to such systems by gravity. However, recirculation pumps can be provided, and the gutters can also be provided with jet water inlets to direct a driving flow of water along the gutter, to flush out the gutters, and to drive water along the gutter towards the water recirculation system. Such jet water inlets are described in U.S. Pat. No. 3,932,397 to Ogden, dated Apr. 13, 1960.

Other variations and modifications of the invention will be apparent to those skilled in the art.

Having regard to the foregoing disclosure, the following is claimed as the inventive and patentable embodiments thereof:

1. A pool perimeter skimming gutter water level control system comprising, in combination, a gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit; at least one surge weir disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the gutter conduit; a weir closure movable between positions opening and closing the weir; a water cleaning and recirculating system for collecting water from the pool and water flowing into and along the gutter conduit, cleaning it, and returning it to the pool; an overflow sensor actuated when sensing a water level in the overflow downstream of the pool characteristic of a low threshold of pool activity, but excessive weir skimming flow, and arranged when actuated to close at least one weir closure; and means overriding the overflow sensor when not so actuated to close the weir closure and direct all skimming flow over the top rim of the retaining wall.

2. A pool perimeter skimming gutter water level control system according to claim 1, comprising a second overflow sensor sensing a water level in the overflow downstream of the pool characteristic of a below-normal pool level, and arranged to open a make-up valve to add water to the pool to restore level to normal, and a third sensor sensing normal pool level and arranged to close the make-up valve when normal level is reached.

3. A twin-gutter pool perimeter skimming gutter water level control system comprising, in combination, a first gutter conduit for disposition about the perimeter of a swimming pool, and adapted to carry water at a level below a predetermined level of water in the swimming pool; a retaining wall on the pool side of the gutter conduit, over the top rim of which wall water may flow from the pool into the gutter conduit; a second gutter conduit for disposition about the perimeter of a swimming pool, and adapted to carry water at a level below a predetermined level of water in the swimming pool; at least one surge weir disposed through the retaining wall below the top thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top rim of the wall into the first gutter conduit; a weir closure movable between positions opening and closing the weir; a water cleaning and recirculating system for collecting water from the pool and water flowing into and along the first and second gutter conduits, cleaning it, and returning it to the pool; and an overflow sensor actuated when sensing a water level in the overflow downstream of the pool characteristic of a low threshold of pool activity but excessive weir skimming flow, and arranged when so actuated to close at least one weir closure; and means overriding the overflow sensor when not so actuated to close the weir closure and direct all skimming flow over the top rim of the retaining wall.

4. A twin-gutter pool perimeter skimming gutter water level control system according to claim 3, comprising a second overflow sensor sensing a water level in the overflow downstream of the pool characteristic of a below-normal pool level, and arranged to open a make-up valve to add water to the pool to restore level to normal, and a third sensor sensing normal pool level and arranged to close the make-up valve when normal level is reached.

5. A twin-gutter pool perimeter skimming gutter water level control system comprising, in combination, a first gutter conduit for disposition about the perimeter of a swimming pool, and adapted to carry water at a level below a predetermined level of water in the swimming pool; a retaining wall on the pool side of the first gutter conduit, over the top rim of which wall water may flow from the pool into the first gutter conduit; a second gutter conduit for disposition about the perimeter of a swimming pool, and adapted to carry water at a level below a predetermined level of water in the swimming pool; at least one surge weir disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flows, wave actions and sures up to a predetermined minimum, while allowing excessive flows, wave actions and surges beyond such minimum to flow over the top rim of the wall into the first gutter conduit; a weir closure movable between positions opening and closing the weir; a water cleaning and recirculating system for collecting water from the pool and water flowing into and along the first and second gutter conduits; cleaning it, and returning it to the pool; a first gutter sensor actuated when sensing a first water level in a gutter characteristic of a low threshhold of pool activity but excessive weir skimming flow, and arranged when so actuated to close at least one weir closure; means overriding the overflow sensor when not so actuated to close the weir closure and direct all skimming flow over the top rim of the retaining wall; and a second sensor sensing a second higher level in the second gutter characteristic of a high degree of water flow, wave actions and surges into the first gutter conduit, and arranged to increase water recirculation system capacity to recirculate such increased gutter flow and prevent wash-back from a gutter conduit to the pool.

6. A twin-gutter automated pool perimeter skimming gutter water level control system comprising, in combination, a first gutter for disposition about the perimeter of a swimming pool, and adapted to carry water at a level below a predetermined level of water in the swimming pool; a retaining wall on the pool side of the first gutter conduit, over the top of which wall water may flow from the pool into the first gutter conduit; a second gutter conduit for disposition about the perimeter of a swimming pool, and adapted to carry water at a level below a predetermined level of water in the swimming pool; at lest one surge weir disposed through the retaining wall below the top thereof, at a height to maintain a predetermined water level in the pool, and to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the first gutter conduit; a weir closure movable between positions opening and closing the weir; a water cleaning and recirculating system for collecting water from the pool and water flowing into and along the first and second gutter conduits, cleaning it, and returning it to the pool; and including a water recirculation throttling valve controlling the capacity for recirculating water flow of the water cleaning and recirculating system; a first gutter sensor actuated when sensing a higher water level in a gutter characteristic of a low threshhold of pool activity but excessive weir skimming flow, and arranged when so actuated to close at least one weir closure; means overriding the overflow sensor when not so actuated to close the weir closure and direct all skimming flow over the top rim of the retaining wall; a second sensor sensing a higher level in a gutter characteristic of a high degree of water flow, wave action and surges into the first gutter conduit, and arranged to increase water recirculation system capacity to recirculate such increased gutter flow to the pool; and a third sensor sensing a higher level in a gutter characteristic of a higher degree of water flow, wave action and surges into the conduit, and arranged to adjust the water recirculation throttling valve to increase recirculation system capacity to accommodate such increased gutter flow, and prevent wash-back from a gutter conduit to the pool.

7. A pool perimeter skimming gutter water level control system comprising, in combination, a gutter conduit for disposition about the perimeter of a swimming pool, and adapted to carry water at a level below a predetermined level of water in the swimming pool; a retaining wall on the pool side of the first gutter conduit, over the top rim of which wall water may flow from the pool into the first gutter conduit; at least one surge weir disposed through the retaining wall below the top rim thereof, at a height to maintain a predetermined water level in the pool, and to provide a skimming flow of water through the weir at such predetermined water level in the pool, the top rim of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the gutter conduit; a weir closure movable between positions opening and closing the weir; a water cleaning and recirculating system for collecting water from the pool and water flowing into and along the gutter conduit, cleaning it, and returning it to the pool; a first gutter sensor actuated when sensing a first water level in a gutter characteristic of a low threshold of pool activity but excessive weir skimming flow, and arranged when so actuated to close at least one weir closure; means overriding the overflow sensor when not so actuated to close the weir closure and direct all skimming flow over the top rim of the retaining wall; and a second sensor sensing a second higher level in the gutter characteristic of a high degree of water flow, wave actions and surges into the gutter conduit, and arranged to increase water recirculation system capacity to recirculate such increased gutter flow and prevent wash-back from the gutter conduit to the pool.

* * * * *

UNITED STATES PATENT AND TRADEMARK OFFICE

CERTIFICATE OF CORRECTION

PATENT NO. : 4,133,059

DATED : January 9, 1979

INVENTOR(S) : William H. Baker

It is certified that error appears in the above-identified patent and that said Letters Patent are hereby corrected as shown below:

| | | |
|---|---|---|
| Column 6, line 48 | : | "above" should be --about--. |
| Column 11, line 34 | : | "coduit" should be --conduit--. |
| Column 15, line 67 | : | "six" should be --five--. |
| Column 20, line 9 | : | "lvel" should be --level--. |
| Column 20, line 37 | : | "polytetrfluoroethylene" should be --polytetrafluoroethylene--. |
| Column 23, line 15 | : | "sures" should be --surges--. |
| Column 23, line 49 | : | "lest" should be --least--. |

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*